United States Patent [19]

Heitmann

[11] Patent Number: 4,889,139

[45] Date of Patent: Dec. 26, 1989

[54] METHOD OF AND MACHINE FOR MAKING A ROD-LIKE FILLER OF FIBROUS MATERIAL

[75] Inventor: Uwe Heitmann, Hamburg, Fed. Rep. of Germany

[73] Assignee: Körber AG, Hamburg, Fed. Rep. of Germany

[21] Appl. No.: 195,105

[22] Filed: May 16, 1988

[30] Foreign Application Priority Data

May 27, 1987 [DE] Fed. Rep. of Germany ..... 3717991

[51] Int. Cl.[4] ..... A24C 05/39

[52] U.S. Cl. ..... 131/84.3; 131/84.4; 131/84.1; 406/78; 406/82

[58] Field of Search ..... 131/84.3, 84.4, 110, 131/84.1, 84.2; 34/208, 216, 217; 209/905; 406/78, 82

[56] References Cited

U.S. PATENT DOCUMENTS

| | | | |
|---|---|---|---|
| 3,731,693 | 5/1973 | Pocock | 131/84.3 |
| 3,841,337 | 10/1974 | Varner | 131/84.3 |
| 3,941,036 | 3/1976 | Molins et al. | 131/84.3 X |
| 4,461,307 | 7/1984 | Hoffmann | 131/84.3 |

FOREIGN PATENT DOCUMENTS

| | | | |
|---|---|---|---|
| 2124471 | 2/1984 | United Kingdom | 131/84.1 |

*Primary Examiner*—V. Millin

*Assistant Examiner*—David F. Crosby

*Attorney, Agent, or Firm*—Peter K. Kontler

[57] ABSTRACT

A stream which advances along the underside of the elongated lower reach of an endless air-permeable belt conveyor carries a surplus of fibrous material and is relieved of the surplus by a trimming device which is mounted downstream of one or more nozzles serving to direct compressed air at a variable rate against successive increments of the stream and to thus loosen the stream to a greater or lesser extent, at least in a region immediately adjacent the underside of the lower reach of the conveyor. The upper side of the lower reach of the conveyor is adjacent a suction chamber which attracts the stream to the conveyor. The action of suction upon the stream in the region of the nozzle. or nozzles can be weakened or elminated by the nozzle or nozzles or by a discrete barrier. The density of the trimmed stream is monitored and the results of the monitoring operation are used to regulate the rate of admission of compressed air to the nozzle or nozzles so that the rate of admission respectively increases and decreases when the density is excessive or too low. The nozzle or nozzles can obviate the need for adjustment of the trimming device relative to the lower reach of the conveyor. The trimmed stream is draped into a web of cigarette paper or the like and is subdivided into rod-shaped smokers' products, such as cigarettes, cigars, cigarillos or filter rod sections.

26 Claims, 3 Drawing Sheets

METHOD OF AND MACHINE FOR MAKING A ROD-LIKE FILLER OF FIBROUS MATERIAL

BACKGROUND OF THE INVENTION

The invention relates to a method of an to a machine for making rod-like fillers of fibrous material, such as natural, reconstituted or substitute tobacco or filter material for tobacco smoke. More particularly, the invention relates to improvements in a method of and in an apparatus for making rod-shaped fillers of fibrous material which is supplied to one side of an air-permeable conveyor whereon the fibrous material forms a continuous stream which contains a surplus and is advanced past a trimming or equalizing device which removes the surplus so that the thus trimmed or equalized stream constitutes a rod-shaped filler which is ready for draping into a web of cigarette paper or other suitable draping material so as to form a continuous cigarette, cigarillo, cigar or filter rod.

It is well known to build a continuous stream of fibrous material along one side, particularly along the underside, of an endless air-permeable belt conveyor while the other side of the conveyor is acted upon by suction so that the fibrous material is attracted to and advances with the conveyor in the desired direction, namely toward and past the trimming device prior to entering the draping station where the filler is converted into a rod. The surplus removing or trimming device can comprise one or more rotary disc-shaped members which grip the particles of fibrous material at a selected distance from the underside of the conveyor, and a brush or a milling tool which segregates the fibrous material beneath the disc or discs from the major part of the stream.

U.S. Pat. No. 3,731,693 discloses a rod making machine wherein the density of the filler is influenced by monitoring the density of the filler and by regulating suction which is applied to attract the stream of unequalized fibrous material to the air-permeable conveyor. This renders it possible to mount the trimming device at a fixed distance from the conveyor so that the machine can operate properly, namely produce a filler of desired density, without relying on complex and expensive means for moving the trimming device relative to the conveyor.

U.S. Pat. No. 4,574,816 discloses a machine wherein the trimming device is installed at a fixed distance from the air-permeable conveyor and the density of the filler is regulated by varying the rate of admission of fibrous material into the stream building zone in dependency upon the intensity and/or other characteristics of signals which are transmitted by a device serving to monitor the density of the trimmed stream. The rate of admission of fibrous material is increased when the density of the filler is too low, and the rate of admission of fibrous material is reduced when the monitored density is excessive. It was further proposed to additionally regulate suction in the chamber which serves to attract the stream to the air-permeable conveyor, namely to regulate suction in dependency upon the changes of intensity and/or other characteristics of signals from the density monitoring device so that suction is increased (i.e., the pressure in the suction chamber is reduced) when the density of the filler is too low, and vice versa.

U.S. Pat. No. 3,750,675 discloses a machine which is analogous to that of the aforementioned U.S. Pat. No. 3,731,693. Thus, the position of the trimming device remains unchanged but suction which is applied to attract the stream of fibrous material to the foraminous conveyor is regulated in dependency upon the characteristics of signals which are generated by a density or mass monitoring device.

U.S. Pat. No. 4,306,573 discloses a machine wherein the trimming device is movable relative to the air-permeable conveyor in dependency upon signals which denote variations of resistance of the rod-shaped filler to the flow of a gaseous fluid therethrough.

British Pat. No. 2,133,967 discloses a machine wherein the trimming device is fixed relative to the air permeable conveyor and the density monitoring device transmits signals which are utilized to regulate the speed of the conveyor so as to maintain the density of the filler at a constant value.

OBJECTS AND SUMMARY OF THE INVENTION

An object of the invention is to provide a novel and improved method of ensuring that the density of a rod-like filler of fibrous material which can be utilized for the making of plain or filter cigarettes, cigars, cigarillos or filter rod sections is maintained within a desired range.

Another object of the invention is to provide a novel and improved method of maintaining the characteristics of a continuous rod-like filler of fibrous material within a desired range.

A further object of the invention is to provide a method which renders it possible to properly and automatically regulate the density of a rod-like filler of fibrous material while the trimming device which removes the surplus of fibrous material from a continuously advancing stream of such material remains at a fixed distance from the conveyor for the stream of fibrous material.

An additional object of the invention is to provide a method wherein the force with which the stream of fibrous material is attracted to the air-permeable conveyor of a cigarette rod making or like machine is regulated in a novel and improved way.

Still another object of the invention is to provide a novel and improved machine for making cigarette rods, cigar rods, cigarillo rods and/or rods of fibrous filter material for tobacco smoke.

A further object of the invention is to provide the machine with novel and improved means for influencing the density of the stream of fibrous material so as to ensure that the density of the rod-like filler which is obtained in response to removal of surplus from the stream will remain within a desired range.

An additional object of the invention is to provide the machine with novel and improved means for influencing the stream of fibrous material ahead of the surplus removing station.

Another object of the invention is to provide the machine with novel and improved means for counteracting suction in the region where the stream of fibrous material is transported toward the surplus removing station.

An additional object of the invention is to provide a novel and improved cigarette rod making machine wherein the trimming device may but need not be adjustable relative to the conveyor for the stream of fibrous material.

One feature of the invention resides in the provision of a method of forming a rod of fibrous material for conversion into rod-shaped articles of the tobacco processing industry, such as plain cigarettes, cigars, cigarillos or filter rod sections. The method comprises the steps of supplying fibrous material into a first portion of a predetermined path which is defined by one side (preferably the underside) of an air-permeable conveyor, applying suction to the other side of the conveyor so that the fibrous material is attracted to the one side of the conveyor and forms a continuous stream which contains a surplus of fibrous material and advances along the path in a predetermined direction, removing the surplus from the stream in a second portion downstream of the first portion of the path so that the thus equalized stream forms a rod-like filler which is ready for draping into a web of cigarette paper or the like, and directing against successive increments of the stream at least one current of compressed air in a third portion intermediate the first and second portions of the path so that the current has a component which urges successive increments of the stream away from the one side of the conveyor to thereby at least loosen the stream if the stream is not at least partially separated from the conveyor.

The aforementioned component of the at least one current of compressed air can at least reduce the effect of suction upon the increments of the stream in the third portion of the path.

The method can further comprise the step of varying the rate of admission of compressed air to the third portion of the path, including supplying compressed air at a predetermined constant rate when the speed and/or the density of the filler matches a preselected optimum value.

The method can also comprise the steps of monitoring the density of the filler and changing the rate of admission of compressed air to the third portion of the path in response to changes of monitored density of the filler. The changing step can include increasing the rate of admission of compressed air when the monitored density increases and reducing the rate of admission of compressed air when the monitored density decreases. The monitored density can be compared with a predetermined reference value which is indicative of the desired optimum density, and the changing step can include increasing the rate of admission of compressed air when the monitored density exceeds the reference value and reducing the rate of admission of compressed air when the monitored density is less than the reference value.

Another feature of the invention resides in the provision of a machine for forming a rod of fibrous material, particularly a rod of tobacco or filter material. The machine comprises an air-permeable conveyor which defines an elongated path, means for supplying fibrous material to one side (preferably the underside) of the conveyor in a first portion of the path, a suction chamber which is adjacent the other side of the conveyor so that the conveyor attracts the fibrous material which forms a stream containing a surplus of fibrous material and advancing in a predetermined direction along the path, means for removing the surplus from the stream in a second portion downstream of the first portion of the path so that the thus equalized stream forms a rod-like filler which is ready for draping and subdivision into sections of desired length, and means for directing against successive increments of the stream at least one current of compressed air in a third portion intermediate the first and second portions of the path so that the current at least loosens the stream. The directing means can comprise means for imparting to the current an orientation such that the current has a component which urges successive increments of the stream way from the one side of the conveyor.

In accordance with a presently preferred embodiment of the machine, the directing means comprises a source of compressed air, at least one nozzle which is adjacent the third portion of the path, conduit means connecting the nozzle with the source, and adjustable valve means provided in the conduit means and serving to regulate the rate of admission of compressed air to the nozzle. The nozzle can be placed adjacent the other side of the conveyor so that the current of compressed air which issues from the nozzle must traverse the conveyor prior to impinging upon successive increments of the stream in the third portion of the path. Such nozzle can have a substantially polygonal (for example, square or rectangular) air-discharging orifice.

Alternatively, the nozzle can be disposed between the suction chamber and the other side of the conveyor so that it at least substantially prevents the suction chamber from attracting the stream to the one side of the conveyor in the third portion of the path. Such nozzle can have a relatively large air-discharging orifice which is adjacent the other side of the conveyor.

Still further, the nozzle can be installed adjacent the one side of the conveyor so that the current or currents of air which issue from the nozzle impinge directly upon successive increments of the stream in the third portion of the path. Such machine can further comprise sidewalls which flank the stream in the third portion of the path. The nozzle of such machine can include channels which are provided in the sidewalls and serve to direct jets or currents of compressed air against successive increments of the stream in the third portion of the path. If the one side is the underside of the conveyor, the channels are preferably inclined relative to the predetermined direction and are oriented to convey compressed air from a higher level to a lower level prior to discharging compressed air into the stream in the third portion of the path. Such machine can further comprise an impermeable barrier which is interposed between the suction chamber and the other side of the conveyor in the third portion of the path so that the suction chamber cannot interfere with loosening action of the currents which issue from the nozzle at the one side of the conveyor.

It is further possible to move the nozzle along the predetermined path in and counter to the predetermined direction. This can be achieved by providing suitable means (for example a fluid-operated double-acting cylinder and piston unit or a rack and pinion drive) for moving the nozzle relative to the conveyor in the longitudinal direction of the path.

The directing means can comprise a plurality of nozzles each of which is arranged to discharge at least one current of compressed air against successive increments of the stream in the third portion of the path. One of these nozzles is preferably disposed between another nozzle and the surplus removing means, i.e., one of the nozzles is nearer to the surplus removing means than at least one other nozzle.

The aforementioned conduit means can comprise first conduit means which connects the source of compressed air with the aforementioned nozzle, adjustable first valve means provided in the first conduit means and serving to regulate the rate of admission of compressed air to the nozzle, and second conduit means connecting the source with the nozzle and serving to admit to the nozzle compressed air at a substantially constant rate. Such second conduit means can contain second valve means which can be set to permit compressed air to flow from the source to the orifice or orifices of the nozzle at substantially constant rate. The machine can further comprise means for monitoring the density of the filler and means for adjusting the first valve means in response to fluctuations of monitored density of the filler. The monitoring means can include means for generating signals which denote the density of the filler, and the adjusting means can include a source of reference signals which denote the desired density of the filler, means for comparing the signals from the monitoring means with the reference signals, and means for actually changing the rate of air flow through the first valve means when the signals from the monitoring means deviate from the reference signals. The means for changing the rate of flow of compressed air preferably includes means for increasing the rate of air flow when the monitored density is excessive and for reducing the rate of air flow when the monitored density is too low.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
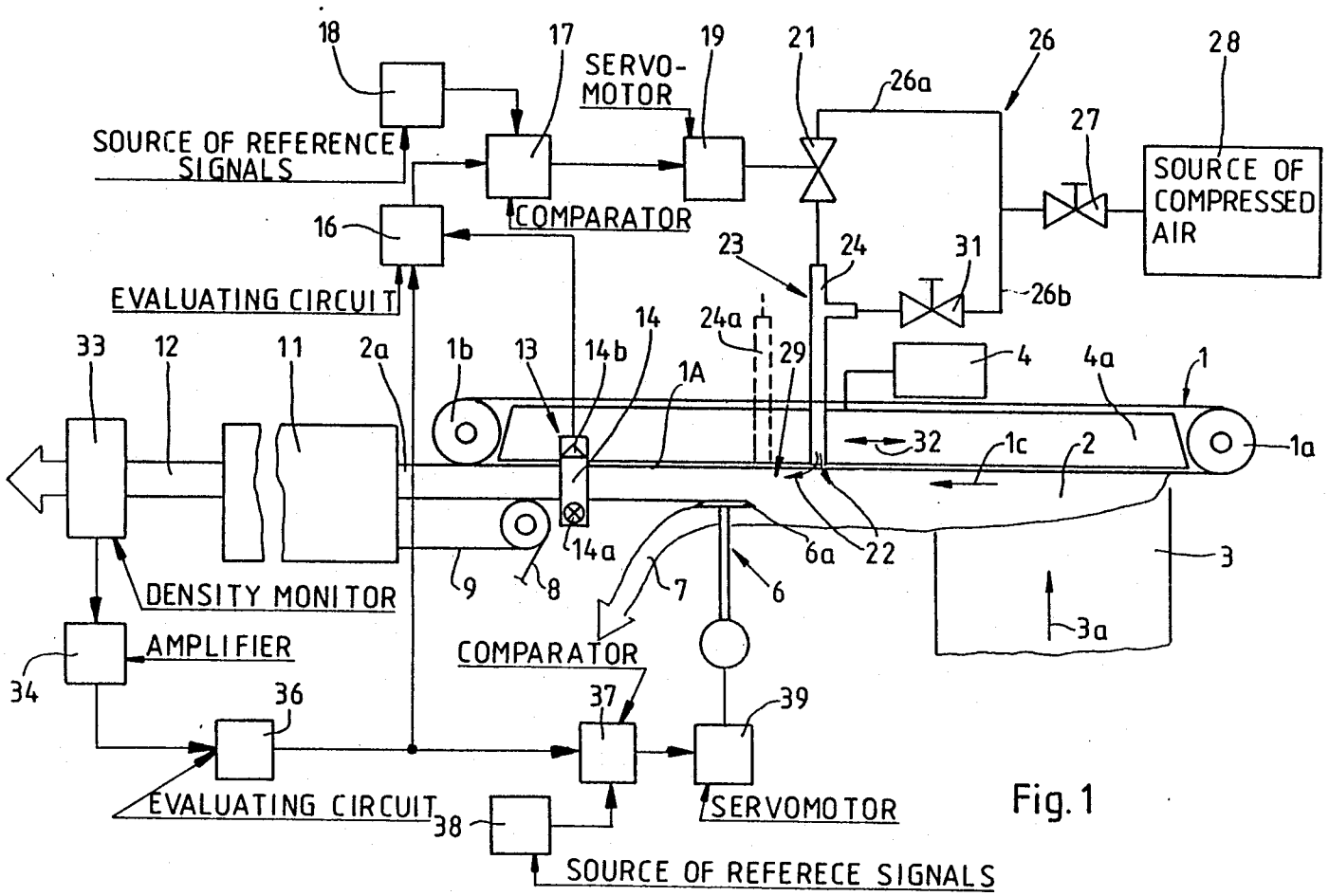
FIG. 1 is a fragmentary diagrammatic view of a cigarette rod making machine which embodies one form of the invention and wherein the means for directing compressed air against successive increments of the stream of fibrous material comprises two nozzles.

Referring first to FIG. 1, there is shown a portion of a cigarette rod making machine wherein an endless air-permeable belt conveyor 1 is trained over pulleys 1*a* and 1*b* so that its lower reach 1A advances in the direction of arrow 1*c*. The means for supplying fibrous material (such as shreds of tobacco leaves or fragmentized tobacco ribs) comprises an upright duct 3 wherein a shower of fibrous material is caused to ascend in the direction of arrow 3*a* to enter a first portion of the elongated path which is defined by the lower reach 1A of the conveyor 1. The thus delivered fibrous material forms a continuous stream 2 which is advanced in the direction of the arrow 1*c* and contains a surplus 7 of fibrous material. Such surplus is removed by a removing means 6 including a customary trimming or equalizing device with one or more trimming discs 6*a* so that the equalized stream 2*a* which advances beyond the trimming device 6 constitutes a substantially rod-like filler of constant cross-sectional area. Such filler is then draped into a web 8 of cigarette paper or other suitable wrapping material during travel with a further endless conveyor 9 (the so-called garniture belt) through a conventional wrapping mechanism 11 wherein the web 8 is converted into a tube surrounding the densified filler 2*a* so that the tube and densified filler together form a cigarette rod 12 which is ready to be subdivided into plain cigarettes of unit length or multiple unit length. The mode of making the rod 12 is the same if the fibrous material which is delivered by the duct 3 serves for the making of a cigar or cigarillo rod or a rod of fibrous material which can be subdivided into filters for tobacco smoke.

The upper side of the lower reach 1A of the conveyor 1 is adjacent the open or partly open underside of a stationary suction chamber 4*a* which is connected with a suitable suction generating device 4 and ensures that the particles of fibrous material which are delivered by the duct 3 share the movement of the lower reach 1A in the direction of the arrow 1*c*.

The distance between the trimming disc or discs 6*a* of the trimming device 6 from the underside of the lower reach 1A of the conveyor 1 determines the height of the filler 2*a* and hence the quantity of fibrous material per unit length of the cigarette rod 12.

The trimming device 6 is located downstream of the duct 3 and upstream of a density monitoring device 13 which includes a detector 14 having a radiation source 14*a* at the underside of the filler 2*a* and a photoelectronic or other suitable transducer 14*b* which is exposed to radiation that issues from the source 14*a* and penetrates across the filler 2*a*. Signals which are generated by the transducer 14*b* are indicative of the density of successive increments of the filler 2*a* . The source 14*a* can emit visible light, infrared light or other radiation which is capable of penetrating across successive increments of the filler 2*a*. If desired, the detector 14 can comprise several radiation sources 14*a* all of which direct radiation toward a single transducer 14*b*.

The output of the transducer 14*b* is connected with one input of an evaluating circuit 16 which processes the signals and transmits processed signals to a comparator circuit 17. The circuit 17 is further connected with a source 18 of reference signals which are indicative of the desired or optimum density of successive increments of the filler 2*a*. The output of the comparator circuit 17 transmits a signal to a further circuit 19 when the intensity or another characteristic of the signal from the evaluating circuit 16 deviates from the same characteristic of the reference signal which is transmitted by the source 18. The circuit 19 constitutes a means for changing the rate of air flow through an adjustable valve 21 which forms part of a means 23 for directing currents of compressed air against successive increments of the stream 2 between the duct 3 and the trimming device 6. The circuit 19 can control or include a servomotor which, in turn, can change the rate of flow of compressed air through the adjustable valve 21. The means 23 for directing compressed air against the stream 2 in the region upstream of the timing device 6 further includes a source 28 of compressed air and conduit means 26 which contains a master valve 27 and includes a first conduit 26*a* connecting the master valve 27 with the adjustable valve 21 and with a nozzle 24 which discharges one or more currents 22 of compressed air against successive increments of the stream 2 between that portion of the path wherein the stream 2 is formed and the path portion which is adjacent the trimming device 6. The conduit means 26 further comprises a second conduit 26*b* which connects the nozzle 24 with the master valve 27 independently of the adjustable valve 21 and contains a further valve 31 which is normally set to admit to the nozzle 24 compressed air at a constant rate. Such constant rate suffices for the purposes of the invention when he velocity of the stream 22 and the density of the filler 2*a* match optimum values.

Each current 22 of compressed air which issues from the orifice or orifices of the nozzle 24 in the path portion 29 has a component extending transversely of the direction of the arrow 1*c* so that such component counteracts the subatmospheric pressure in the chamber 4*a*. In other words, the current or currents 22 at least loosen successive increments of the stream 2 on their way toward the equalizing station accommodating the trimming device 6. If desired or necessary, the current or currents 22 can even slightly separate the upper side of the stream 2 from the underside of the lower reach 1A of the air-permeable conveyor 1. The loosening action of the current or currents 22 entails a thickening or widening of the respective increments of the stream 2 so that the surplus 7 contains a larger quantity of fibrous material than if the master valve 27 were closed so that the orifice or orifices of the nozzle 24 would be unable to discharge compressed air. The quantity of compressed air which is discharged by the nozzle 24 determines the quantity of surplus 7 which is removed by the trimming device 6 to thus influence the density of the filler 2*a*. The arrangement is such that the quantity of surplus 7 which is removed by the trimming device 6 is increased if the density of the filler 2*a* (as determined by the monitoring device 13) is higher than indicated by the intensity or another characteristic of the reference signal which is furnished by the source 18, and that the quantity of compressed air which is discharged by the nozzle 24 is reduced when the density of the filler 2*a* is too low, i.e., when the signal from the comparator circuit 17 to the circuit 19 is indicative that the intensity or another characteristic of the signal from the evaluating circuit 16 is less than the intensity of the reference signal which is transmitted by the source 18. Thus, the means 23 for directing compressed air against successive increments of the stream 2 can replace the means for adjusting the level of the trimming disc or discs 6*a* relative to the level of the lower reach 1A of the conveyor 1.

The valve 31 in the conduit 26*b* ensures that the nozzle 24 invariably receives a minimum quantity of compressed air as long as the master valve 27 is open. The adjustable valve 21 can increase the quantity of compressed air to an extent which is determined by the adjusting means including the components 16–19 serving to change the rate of flow of compressed air in the conduit 26*a* by increasing or reducing the effective cross-sectional area of the passage in the adjustable valve 21.

The path portion 29 where the nozzle 24 discharges compressed air against the stream 2 is located sufficiently upstream of the trimming station to ensure that the loosening and expanding action of the current or currents 22 of compressed air is felt in the stream 2 at the time when successive increments of the stream reach the path portion where the trimming disc or discs 6*a* remove the surplus 7 from the remaining portion of the stream 2 so that the remaining portion constitutes the rod-shaped filler 2*a*. The parameter which influences the distance between the path portion 29 and the trimming device 6 is the velocity of the conveyor 1. In order to ensure that the distance from the nozzle 24 and the trimming device 6 (as seen in the direction of arrow 1*c*), will always match or approximate an optimum value, it is advisable to movably mount the orifice of the nozzle 24 or the entire nozzle so that it can be shifted in directions which are indicated by a double-headed arrow 32. The means (symbolized by the arrow 32) for actually moving the nozzle 24 in and counter to the direction of arrow 1*c* can comprise a double-acting hydraulic or pneumatic cylinder and piston unit or a rack and pinion drive. It will be understood that the conduits 26*a* and 26*b* will then constitute flexible hoses or will contain flexible portions so as to enable the nozzle 24 to move relative to the source 28 and relative to the trimming device 6, with or without the valves 21, 27 and 31.

The arrangement is preferably such that, when the machine embodying the structure of FIG. 1 is started, the nozzle 24 is moved nearer to the trimming device 6 because the conveyor 1 then advances the stream 2 at a relatively low speed. However, when the conveyor 1 reaches its nominal (maximum) speed, the orifice or orifices of the nozzle 24 are preferably moved further away from the trimming device 6 (toward the duct 3) because successive increments of the stream 2 then advance at a higher speed and would be unable to properly expand or to become adequately loosened prior to reaching the trimming device 6 if the nozzle 24 were to remain close to the disc or discs 6*a*, namely at the same distance as during starting of the machine when the conveyor 1 is driven (by the pulley 1*a* or 1*b*) at a relatively low speed.

FIG. 1 further shows by broken lines a second nozzle 24*a* which is disposed between the nozzle 24 and the trimming device 6. The nozzle 24*a* can be utilized when the conveyor 1 is driven at a relatively low speed, and the nozzle 24 is then utilized when the conveyor 1 is driven at full speed. If the machine comprises two nozzles (such as the nozzles 24 and 24*a*), it is necessary to ensure that the nozzle 24 remains sealed from the source 28 of compressed air when the nozzle 24*a* discharges compressed air during the initial stage of operation of the machine, and that the nozzle 24*a* is sealed from the source 28 of compressed air when the speed of the conveyor 1 is increased so that compressed air is to be discharged by way of the orifice or orifices of the nozzle 24. Disconnection or sealing of nozzles 24, 24*a* from the source 28 of compressed air can take place automatically, e.g., in response to signals from a device (not shown) which monitors the speed of the conveyor 1.

It has been found that in a modern cigarette rod making machine, wherein the starting stage is relatively short (namely wherein the conveyor 1 can be rapidly accelerated from zero speed to its nominal speed), it suffices to provide a single nozzle (24) and to install such nozzle at a fixed distance from the trimming device 6.

The heretofore described component parts of the improved machine ensure that the means 23 for directing compressed air against successive increments of the stream 2 in the path portion 29 can automatically and rapidly compensate for deviations of density of the filler 2a from an optimum value. Therefore, these component parts are particularly suitable for elimination of short-lasting fluctuations of density of the filler 2a. Such adjustment can be carried out without altering the level of the trimming device 6 and its disc or discs 6a.

However, and in order to ensure that the machine can also compensate for long-range departures of density of the filler 2a from an optimum density, the machine preferably further comprises a second density monitoring device 33 which is designed to monitor the density of successive increments of the cigarette rod 12 downstream of the wrapping mechanism 11 and transmits signals to an amplifier 34 which transmits amplified signals to an evaluating circuit 36. The evaluating circuit 36 transmits signals to a comparator circuit 37 which further receives signals denoting the optimum density of the cigarette rod 12 from a source 38 of reference signals. The output of the comparator circuit transmits signals to a servomotor 39 when the intensity of signals from the evaluating circuit 36 deviates from the intensity of reference signals from the source 38. The servomotor 39 then changes the level of the trimming disc or discs 6a so that the trimming device 6 increases or reduces the quantity of fibrous material which forms the removed surplus 7. The density monitoring device 33 can comprise a conventional density detector operating with a source of corpuscular radiation and a transducer in the form of an ionization chamber which transmits to the amplifier 34 signals denoting the density of successive increments of the cigarette rod 12. Such detectors are manufactured and sold by the assignee of the present application.

If desired, signals which are emitted by the evaluating circuit 36 can also be transmitted to the corresponding input of the evaluating circuit 16 of means for adjusting the valve 21. Such signals can be used to test the accuracy of monitoring action of the detector 14. The detector 14 may be prone to malfunction if the color of fibrous material which forms the filler 2a changes, especially if the change is quite pronounced. This is due to the fact that the detector 14 comprises one or more sources of visible light, infrared light or other type of radiation which is not a corpuscular radiation. Signals which are transmitted from the evaluating circuit 36 to the evaluating circuit 16 can be used to correct the signals which are transmitted by the circuit 16 to the comparator circuit 17. In other words, the monitoring action of the device 33 controls or the monitoring action of the device 13.

FIGS. 2 to 6 illustrate three presently preferred embodiments of nozzles 24 which can be utilized in the means 23 for directing compressed air against successive increments of the stream 2 in the path portion 29 upstream of the trimming device 6 and downstream of the duct 3 or another source of fibrous material which is to form the stream. Arrows 41 indicate the direction in which the suction chamber 4a attracts the stream 2 and the filler 2a against the underside of the lower reach 1A of the air-permeable conveyor. Arrows 42 indicate the direction in which compressed air is admitted into the nozzle 24, and the arrows 43 indicate the direction in which the stream 2 and the filler 2a advance with the underside of the lower reach 1A of the air-permeable conveyor 1.

Figure 2:
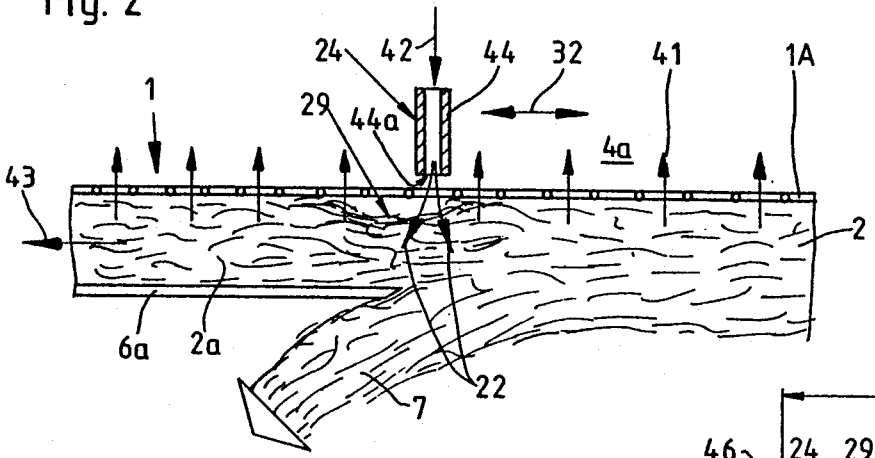
FIG. 2 is an enlarged view of a detail in the machine showing a nozzle which has a polygonal air discharging orifice at that side of the conveyor which faces away from the stream of fibrous material.

Referring first to FIG. 2, the current or currents of compressed air which issue from the discharge end 44 of the nozzle 24 are denoted by the arrows 22. As mentioned above, at least one component of each such current counteracts the subatmospheric pressure in the chamber 4a so as to loosen the fibrous material of the stream 2 ahead of the trimming station, namely ahead of the location where the rotary trimming disc or discs 6a remove the surplus 7 from the stream 2 so that the remainder of the stream 2 forms the filler 2a. The portion 29 of the path for the stream 2 is located immediately ahead of and can even partially overlap the locus of the disc or discs 6a of the trimming device. The discharge end 44 of the nozzle 24 is preferably provided with a polygonal orifice 44a, particularly with a square or rectangular orifice. This ensures that the nozzle 24 can discharge one or more sharply outlined currents 22 of compressed air which can effect a pronounced loosening of fibrous material forming the stream 2 in the region ahead of the trimming station. The extent to which the upper side of the stream 2 becomes separated from the underside of the lower reach 1A of the conveyor 1 in the path portion 29 is exaggerated in FIG. 2 (and also in FIGS. 3 and 4) for the sake of clarity. As a rule, the upper side of each increment of the stream 2 advancing toward the trimming station will remain in actual contact with or very close to the underside of the lower reach 1A of the conveyor 1, even in the region where such increments are acted upon by one or more currents 22 of compressed air issuing from the orifice 44a at the discharge end 44 of the nozzle 24.

It will be noted that, in FIG. 2, the orifice 44a of the nozzle 24 s disposed in the suction chamber 4a so that the current or currents 22 of compressed air must penetrate through the lower reach 1A of the conveyor 1 prior to contacting the fibrous material of the stream 2.

Figure 3:
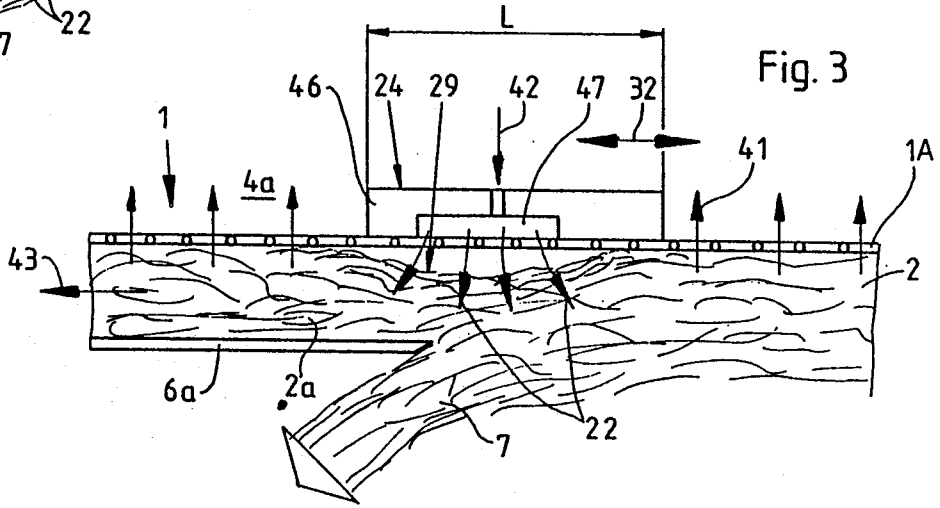
FIG. 3 is a similar view but showing a modified nozzle which prevents the suction chamber from attracting the stream of fibrous material in the third portion of the path.

FIG. 3 shows a modified nozzle 24 which is also disposed in the suction chamber 4a so that the currents of compressed air (shown at 22) which issue from the relatively long outlet or discharge orifice 47 at the underside of the body 46 of the nozzle 24 must again penetrate through the lower reach 1A of the conveyor 1 before they can impinge upon successive increments of the stream 2 ahead of the trimming station, namely in the portion 29 of the path for the stream 2 along the underside of the lower reach 1A. The body 46 of the nozzle 24 is an elongated block having a length L such that the body 46 effectively prevents air flowing in the direction of arrows 41 from attracting the stream 2 to the underside of the lower reach 1A at the station including the portion 29 of the path for the stream 2 and filler 2a. In other words, it is not necessary to employ a large quantity of compressed air in order to effect a desirable loosening of fibrous material of the stream 2 just ahead of the trimming station because those increments which advance along the portion 29 of their path are not acted upon by suction. The currents 22 of compressed air issuing from the orifice 47 of the nozzle 24 which is shown in FIG. 3 are softer than the current 22 which is discharged by the polygonal orifice 44a of the nozzle 24 shown in FIG. 2.

Figure 5:
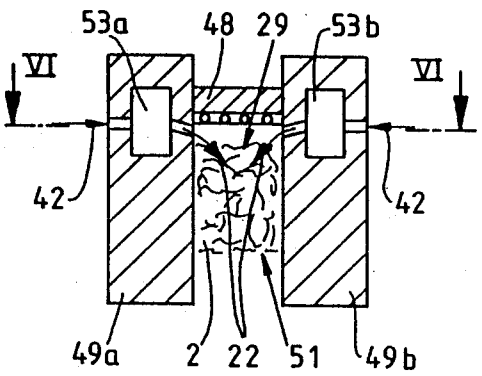
FIG. 5 is a sectional view as seen in the direction of arrows from the line V—V of FIG. 4.
Figure 4:
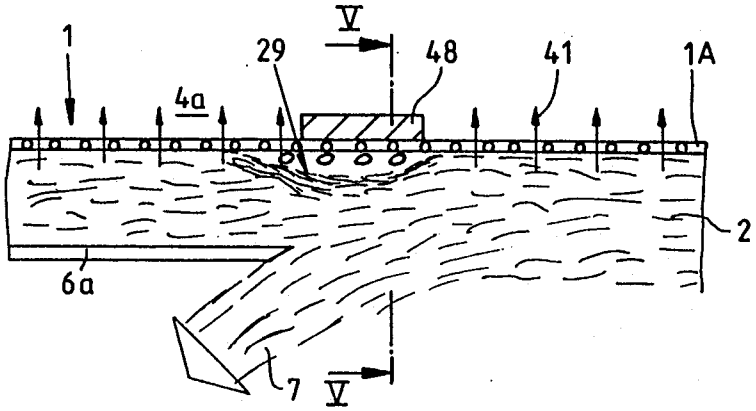
FIG. 4 is a similar view of a composite nozzle which discharges compressed air directly into the stream of fibrous material.
Figure 6:
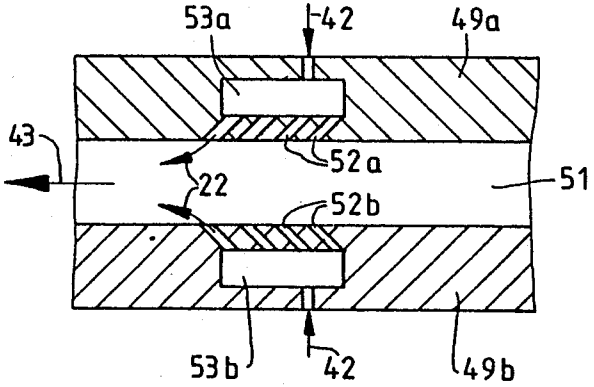
FIG. 6 is a sectional view as seen in the direction of arrows from the line VI—VI of FIG. 5.

FIGS. 4 to 6 show a further embodiment of the means for directing currents 22 of compressed air against successive increments of the stream 2 in the path portion 29. Such directing means comprises an impermeable barrier 48 which overlies the upper side of the lower reach 1A of the conveyor 1 above the path portion 29, and a composite nozzle which is formed partially by one sidewall 49*a* and in part by another sidewall 49*b* of a structure flanking the stream 2 ahead of the trimming or surplus removing station. The composite nozzle of the embodiment which is shown in FIGS. 4 to 6 is located at a level below the lower reach 1A of the conveyor 1 so that currents 22 of compressed air issuing from channels 52*a* and 52*b* which are respectively provided in the inner sides or surfaces of the sidewalls 49*a* and 49*b* can impinge directly upon successive increments of the stream 2 without passing through the lower reach 1A of the conveyor 1. The channels 52*a* and 52*b* discharge compressed air into a passage 51 wherein successive increments of the stream 2 advance toward the trimming station where the surplus 7 is removed by one or more rotary trimming discs 6*a*. It will be noted that the channels 52*a* and 52*b* are inclined relative to the direction (arrow 43) of advancement of the stream 2 with the conveyor 1 and also that the channels 52*a* and 52*b* convey currents of compressed air from a higher level to a lower level so that each such jet has a component of movement in a direction away from the underside of the lower reach 1A with attendant desirable loosening of fibrous material of the stream 2. The manner in which the currents 22 flow from a higher level to a lower level can be seen in FIG. 5, and the manner in which the channels 52*a* and 52*b* are inclined relative to the direction indicated by the arrow 43 can be seen in FIG. 6. The conduit means 26 (not shown in FIGS. 4–6) deliver compressed air in directions which are indicated by arrows 42, and such compressed air enters compartments 53*a* and 53*b* which are respectively provided in the sidewalls 49*a* and 49*b*. The compartments 53*a* and 53*b* respectively admit compressed air to the channels 52*a* and 52*b* for admission into the passage 51 for the stream 2.

It will be readily appreciated that the nozzle or nozzles of the means for directing compressed against successive increments of the stream 2 can be modified in many additional ways without departing from the spirit of the invention. For example, a nozzle of the type shown in FIG. 2 can be used in combination with a nozzle of the type shown in FIG. 3 or in FIGS. 4–6. Analogously, a nozzle of the type shown in FIG. 3 can be used in conjunction with the nozzle of FIGS. 4–6.

An advantage of the nozzle which is shown in FIGS. 4 to 6 is that the currents 22 of compressed air need not pass through the interstices of the lower reach 1A of the conveyor 1. The lower reach 1A acts not unlike a flow restrictor which can interfere with the flow of compressed air into actual contact with the fibrous material of the stream 2. Therefore, the pressure of compressed air which is supplied by the composite nozzle of FIGS. 4–6 can be lower than that of compressed air which is supplied by the nozzle 24 of FIG. 2 or 3.

An important advantage of the improved method and machine is that deviations of density of the filler 2*a* from an optimum density can be eliminated in a fully automatic way and practically instantaneously. This applies especially for short-lasting fluctuations of density.

Another important advantage of the improved method and machine is that the current or currents of compressed air which are directed against successive increments of the stream 2 ahead of the trimming station serve to loosen that portion of the stream which is most likely to have undergone excessive or extensive compression because such portion of the stream is nearest to the underside of the lower reach 1A of the conveyor 1, namely nearest to the suction chamber 4*a*. In other words, the current or currents of compressed air can contribute to greater uniformity of density of the stream 2 ahead of the trimming station. This is desirable because it enhances the quality of the fillers of cigarettes, cigars, cigarillos or filter rod sections which are obtained from the filler 2*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of forming a rod of fibrous material for conversion into rod-shaped articles of the tobacco processing industry, comprising the steps of supplying fibrous material into a first portion of a predetermined path which is defined by one side of an air-permeable conveyor; applying suction to the other side of the conveyor so that the fibrous material is attracted to the one side of the conveyor and forms a stream which contains a surplus of fibrous material and advances along said path in a redetermined direction; removing the surplus from the stream in a second portion downstream of the first portion of the path so that the thus equalized stream forms a rod-like filler; and directing against successive increments of the stream at least one current of compressed air in a third portion intermediate the first and second portions of the path so that the current has a component urging successive increments of the stream away from the one side of the conveyor to thereby at least loosen the stream.

2. The method of claim 1, wherein said component of the at least one current at least reduces the effect of suction upon the increments of the stream in the third portion of said path.

3. The method of claim 1, further comprising the step of varying the rate of admission of compressed air to the third portion of the path, including supplying compressed air at a predetermined constant rate when the speed and/or the density of the filler matches a preselected value.

4. The method of claim 1, further comprising the steps of monitoring the density of the filler, and changing the rate of admission of compressed air to the third portion of the path in response to changes of monitored density of the filler.

5. The method of claim 4, wherein said changing step includes increasing the rate of admission of compressed air when the monitored density increases and reducing the rate of admission of compressed air when the monitored density decreases.

6. The method of claim 4, further comprising the step of comparing the monitored density with a predetermined reference value, said changing step including increasing the rate of admission of compressed air when the monitored density exceeds the reference value and reducing the rate of admission of compressed air when the monitored density is less than the reference value.

7. A machine for forming a rod of fibrous material, particularly a rod of tobacco or filter material, comprising an air-permeable conveyor defining an elongated path; means for supplying fibrous material to one side of the conveyor in a first portion of said path; a suction chamber adjacent the other side of said conveyor so that the latter attracts the fibrous material which forms a stream containing a surplus of material and advancing in a predetermined direction along said path; means for removing the surplus from the stream in a second portion downstream of the first portion of said path so that the thus equalized stream forms a rod-like filler; and means for directing against successive increments of the stream at least one current of compressed air in a third portion intermediate the first and second portions of said path so that the current loosens the stream.

8. The machine of claim 7, wherein said directing means comprises means for imparting to the current an orientation such that the current has a component which urges successive increments of the stream away from the one side of the conveyor.

9. The machine of claim 7, wherein said directing means comprises a source of compressed air, at least one nozzle adjacent the third portion of said path, conduit means connecting said nozzle with said source, and adjustable valve means provided in said conduit means and arranged to regulate the rate of admission of compressed air to said nozzle.

10. The machine of claim 9, wherein said nozzle is adjacent the other side of said conveyor so that the current of compressed air issuing from the nozzle traverses the conveyor prior to impinging upon successive increments of the stream in the third portion of said path.

11. The machine of claim 10, wherein said nozzle has a substantially polygonal air-discharging orifice.

12. The machine of claim 11, wherein said orifice is a square or rectangular orifice.

13. The machine of claim 9, wherein said nozzle is disposed intermediate said suction chamber and the other side of said conveyor so that it at least substantially prevents the suction chamber from attracting the stream to the one side of the conveyor in the third portion of said path.

14. The machine of claim 13, wherein said nozzle has a relatively large air-discharging orifice adjacent the other side of the conveyor.

15. The machine of claim 9, wherein said nozzle is adjacent the one side of the conveyor so that the current of air issuing from the nozzle impinges directly upon successive increments of the stream in the third portion of said path.

16. The machine of claim 15, further comprising sidewalls flanking the stream in the third portion of said path, said nozzle including channels provided in said sidewalls and arranged to direct jets of compressed air against successive increments of the stream in the third portion of said path.

17. The machine of claim 16, wherein said one side is the underside of said conveyor and said channels are inclined relative to said predetermined direction and are arranged to convey compressed air from a higher level to a lower level prior to discharging compressed air into the stream in the third portion of said path.

18. The machine of claim 15, further comprising an impermeable barrier interposed between the suction chamber and the other side of the conveyor in the third portion of said path.

19. The machine of claim 9, wherein said nozzle is movable along said path in and counter to said predetermined direction.

20. The machine of claim 19, further comprising means for moving the nozzle relative to said conveyor.

21. The machine of claim 7, wherein said directing means includes a plurality of nozzles arranged to discharge currents of compressed air against successive increments of the stream in the third portion of said path, said nozzles including a first nozzle and a second nozzle disposed intermediate said first nozzle and said surplus removing means.

22. The machine of claim 7, wherein said directing means comprises a source of compressed air, at least one nozzle adjacent the third portion of said path, first conduit means connecting said source with said nozzle, adjustable first valve means provided in said first conduit means and arranged to regulate the rate of admission of compressed air to said nozzle, and second conduit means connecting said source with said nozzle and arranged to admit to said nozzle compressed air at a substantially constant rate.

23. The machine of claim 22, further comprising second valve means provided in said second conduit means.

24. The machine of claim 7, wherein said directing means includes adjustable valve means arranged to admit to the third portion of said path compressed air at a variable rate, and further comprising means for monitoring the density of the filler, and means for adjusting said valve means in response to fluctuations of monitored density of the filler.

25. The machine of claim 24, wherein said monitoring means includes means for generating signals denoting the density of the filler and said adjusting means includes a source of reference signals denoting the desired density of the filler, means for comparing the signals from said monitoring means with said reference signals, and means for changing the rate of air flow through said valve means when the signals from said monitoring means deviate from said reference signals.

26. The machine of claim 25, wherein said means for changing the rate of flow of compressed air includes means for increasing the rate of air flow when the monitored density is excessive and for reducing the rate of air flow when the monitored density is too low.

* * * * *